US006734778B2

(12) United States Patent
Herbert

(10) Patent No.: US 6,734,778 B2
(45) Date of Patent: May 11, 2004

(54) MODULE FOR MATRIX TRANSFORMERS HAVING A FOUR TURN SECONDARY WINDING

(75) Inventor: Edward Herbert, Canton, CT (US)

(73) Assignee: FMTT, Inc., Canton, CT (US)

( * ) Notice: Subject to any disclaimer, the term of this patent is extended or adjusted under 35 U.S.C. 154(b) by 32 days.

(21) Appl. No.: 10/025,138

(22) Filed: Dec. 19, 2001

(65) Prior Publication Data

US 2002/0075119 A1 Jun. 20, 2002

Related U.S. Application Data

(60) Provisional application No. 60/256,361, filed on Dec. 19, 2000.

(51) Int. Cl.[7] ..... H01F 17/04
(52) U.S. Cl. ..... 336/221; 336/180; 336/213
(58) Field of Search ..... 336/200, 212, 336/213, 183, 222, 180, 181

(56) References Cited

U.S. PATENT DOCUMENTS 2,412,902 A * 12/1946 McElvain
3,768,055 A * 10/1973 Oliver ..... 336/73
4,159,457 A * 6/1979 Charpentier ..... 336/183
6,246,311 B1 * 6/2001 Finnemore et al. ..... 336/192

* cited by examiner

*Primary Examiner*—Anh Mai

(57) ABSTRACT

Four metal foil windings can be bonded to the inside of a magnetic core, each in a 90 degree helix. Very simple direct and straight connections can connect the windings to the windings of another similar core in a flat transformer module with no crossovers or overlaps. The center-tap and output terminations are located similarly to the two turn version of the flat transformer module, but make a module with four turns. This may be used as a push-pull winding having two turns on each side of the center-tap, or it may be used as a four turn winding, as, for instance, with a full bridge rectifier in a power converter.

10 Claims, 3 Drawing Sheets

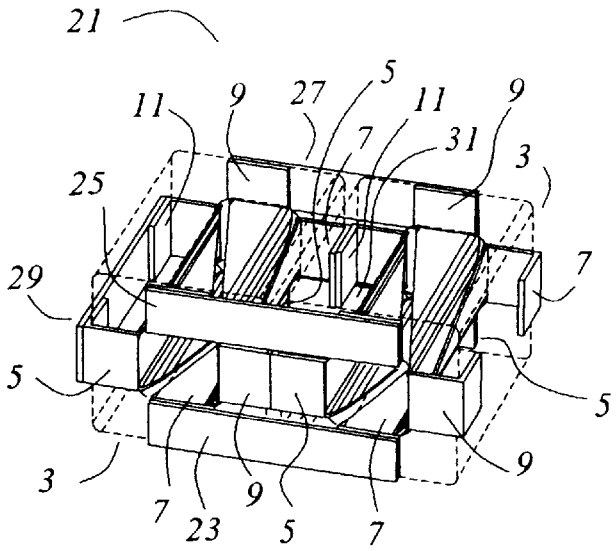
Fig. 5
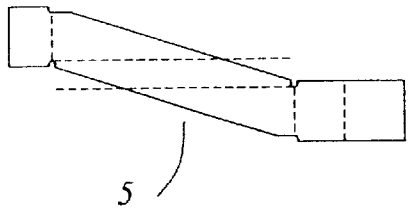
Fig. 6
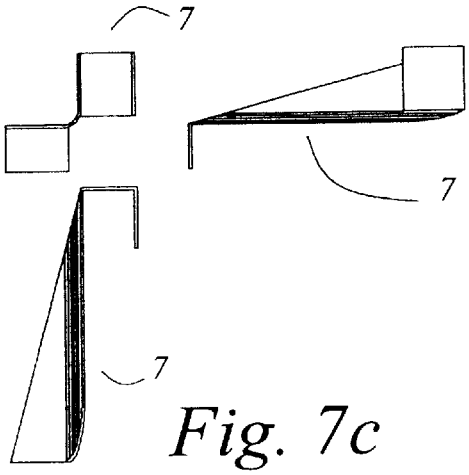
Fig. 7a
Fig. 7b
Fig. 7c

MODULE FOR MATRIX TRANSFORMERS HAVING A FOUR TURN SECONDARY WINDING

This application claims the benefits of provisional application Ser. No. 60/256,361 filed Dec. 19, 2000.

BACKGROUND OF THE INVENTION

This invention relates to modules for matrix transformers and similar applications wherein a metal foil secondary winding is bonded to the inside surface of one or more magnetic cores with terminations being extensions of the metal foil brought to the end or side of the magnetic core. Reference is made to U.S. Pat. No. 4,942,353 "High Frequency Matrix Transformer Power Converter Module" (Herbert, Repp and Cebry). A number of design improvements have been made to this Power Converter Module while bringing it to production, in particular, the use of square cores having a square hole therein.

Until the present invention, all of the modules have used a two turn secondary winding which was usually used as a push-pull winding having one turn on each side of a center-tap termination. If it was necessary to generate more output voltage than this single winding could produce, then more cores were added in series.

In all embodiments of the modules made to the present, the foil windings have been bonded to the inside of the core in a 180 degree helix. The 180 degree helix is not necessary for the electrical or magnetic properties, but it allows a very simple and neat termination of the module, as may be seen in the drawings of the referenced patent and the drawings herein showing prior art. It was not thought to be possible to install more windings and terminate them neatly.

SCOPE OF THE INVENTION

This invention teaches that four metal foil windings can be bonded to the inside of the core, each in a 90 degree helix. Very simple direct connections and straight connections can connect the windings with no crossovers or overlaps and so that the center-tap and output terminations are located similarly to the two turn version yet make a module with four turns. This may be used as a push-pull winding having two turns on each side of the center-tap, or it may be used as a four turn winding, as, for instance, with a full bridge rectifier in a power converter.

Because the terminations are very similar, it can be introduced into present manufacturing with no modifications to the rest of the mechanical parts. Component values may change, though, because the output voltage and current may be different.

\ \ \
\ \ \

BRIEF DESCRIPTION OF THE DRAWINGS

FIG. 5 shows a phantom view of two magnetic cores with their windings and the external interconnections to make a four turn secondary winding.

FIG. 6 shows a possible flat stamping for the windings.

FIGS. 7*a*, 7*b* and 7*c* show an end view, side view and top view respectively of the winding of FIG. 6 after it has been formed.

\ \ \
\ \ \
\ \ \
\ \ \

DESCRIPTION OF THE PREFERRED EMBODIMENT

Figure 1:
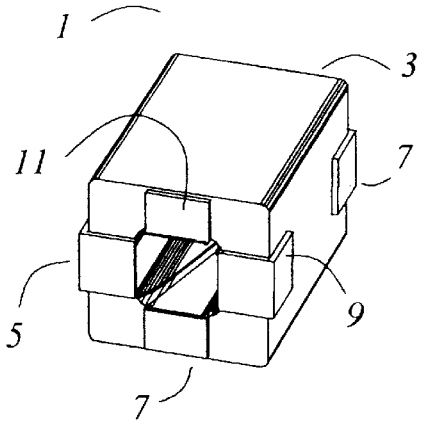
FIG. 1 shows a magnetic core subassembly having four windings installed therein.

FIG. 1 shows a single core module 1 of the present invention. A magnetic core 3 has installed therein four metal foil windings 5, 7, 9 and 11 which pass through the hole in the magnetic core 3 as a 90 degree helix. The magnetic core 3 is preferably made of ferrite and preferably has no gap; however, magnetic cores made of other materials such as sintered metal, laminations, wound tape or whatever as well as cores having two or more parts assembled with one or more gaps certainly may be used and are equivalent for the teachings of this invention.

The metal foil windings 5, 7, 9 and 11 are preferably made of soft copper, as an illustration, not a limitation. They may be identical, as they are shown, and any apparent difference in appearance in FIG. 1 is attributable to the direction from which each is inserted, as will be further explained below. The exact configuration of the terminations of the metal foil windings is a trade off of each specific application, and the configuration shown is as an illustration, not a limitation.

Usually, the metal foil windings 5, 7, 9 and 11 will be used as secondary windings in a matrix transformer, but that is as an illustration, not a limitation. Transformers are reciprocal, so in different applications the metal foil windings could be a primary winding, or they could be one of several secondary windings.

Usually, the matrix transformer modules are assembled without a primary winding, and the through holes therein will receive a primary winding to be added later. The through holes may be lined, as with a Teflon® sleeve.

Figure 2:
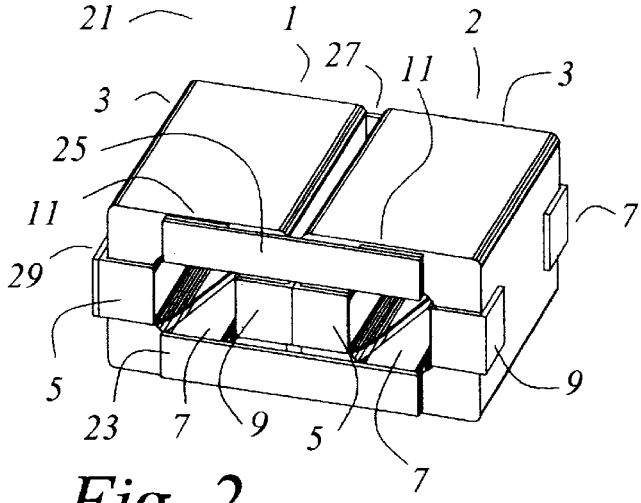
FIG. 2 shows a pair of magnetic cores with windings and terminations.

FIG. 2 shows a matrix transformer module 21 having two magnetic cores 3 each with four metal foil windings 5, 7, 9 and 11 there in, comprising the module 1 of FIG. 1, and another module 2 which is identical to the module 1 of FIG. 1.

As a first step in assembling the module 21 of FIG. 2, the two modules 1 and 2 may be soldered together, side by side such that the winding 9 of module 1 is connected to winding 5 of module 2. On the side that cannot be seen, winding 7 of module 1 is similarly soldered to winding 11 of module 2, as will be further discussed and illustrated below.

As a second step in assembling the module 21 of FIG. 2, a metal strap 29 may be soldered between windings 5 and 11 of module 1 as shown, and this common connection may be the center-tap of a push-pull winding when the rest of the connections are done.

As a third step in assembling the module 21 of FIG. 2, four connecting strap 23, 25, 27 and (hidden, but shown in FIG. 5) 29 may be soldered connecting respective windings 7 and 7, 11 and 11, 9 and 9 and 5 and 5 of modules 1 and 2. This will be further discussed and illustrated below.

The order of assembly suggested is for illustration only, not a limitation. The assembly may be made in any order or simultaneously, and the resulting assembly 21 is the same.

The exposed ends of the metal foil windings 9 and 7 of module 2 may be the output terminations of the module 21, and may, as an illustration, not a limitation, be soldered to leads of a rectifier package in a power converter.

Figure 3:
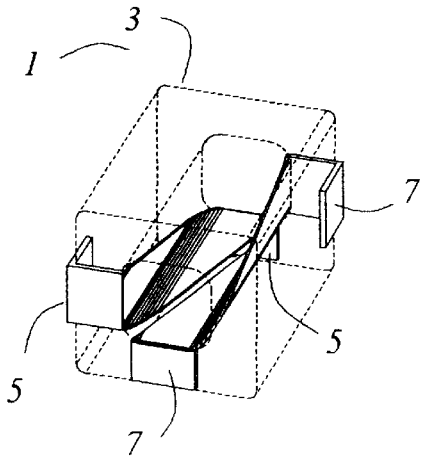
FIG. 3 shows a phantom view of the magnetic core with two of the windings installed.

FIG. 3 shows the module 1 of FIG. 1 partially assembled. The magnetic core 3 is shown in phantom so that the internal configuration of the metal foil windings 5 and 7 may be seen. Each is a 90 degree helix, and each has its respective ends bent to conform to the outside of the magnetic core 3 to be terminations of the respective metal foil windings.

The metal foil winding 5 may be made from copper foil, as shown in FIG. 6. In FIG. 6, the dashed lines indicate bends, as is further illustrated in FIGS. 7*a–c*.

FIGS. 7*a–c* show a metal foil winding 7 which is the same as the metal foil winding 5 of FIG. 6; however, the orientation of the formed winding 7 corresponds in position to the metal foil winding 7 of the other drawings. All of the windings in this example are the same except for orientation. That is for illustration, not as a limitation, but it is advantageous for manufacturing because one part can be used in all four locations.

FIG. 7*a* shows an end view of the formed metal foil winding 7.

FIG. 7*b* shows a side view of the formed metal foil winding 7.

FIG. 7*c* shows a top view of the formed metal foil winding 7. In all three views, and in the other drawings, the metal foil winding 7 is bent twice into a "J" shape on one end, and is bent once into an "L" shape on the other end. A lengthwise bend gives the center of the metal foil winding 7 an "L" shaped section.

Although strictly speaking a helix has a circular path, the form of the metal foil windings may be called a "90 degree helix" even when used in a core having a square hole to represent that it has a twist through 90 degrees so that while it enters the hole on a particular side, it exits the hole on the opposite end on a side that is displaced 90 degrees from the entrance side. The helix may be clockwise or counterclockwise. It would be equivalent to use a magnetic core with a round hole or any other shaped hole. It would be more difficult to form the bends for a hole that did not have flat edges, but using the extended ends of the foil as terminations is an illustration, not a limitation, and other means of attaching electrical conductors to the metal foil windings at the ends of the hole would be equivalent under this invention.

It is preferred that the lengthwise bend be made before the metal foil winding 7 is inserted into the magnetic core 3. The radius of the lengthwise bend should conform to the corner of the square hole in the magnetic core 3. One or more of the other bends may also be made before insertion. One or more of the bends on the ends of the metal foil winding 7 may be made after insertion, and this may be preferred if there is dimensional variance in the magnetic cores 3. This is entirely arbitrary, and is a trade off for each application.

It is contemplated, however, that at least the first bend of the "J" end of the metal foil winding may be made before insertion so as to be a mechanical stop controlling the depth of insertion.

With further reference to FIG. 3, it can be seen that if this is done, the metal foil winding 5 would be inserted from the front side of the core 3 as drawn, and the metal foil winding 7 would be inserted from the back side of the core 3.

Figure 4:
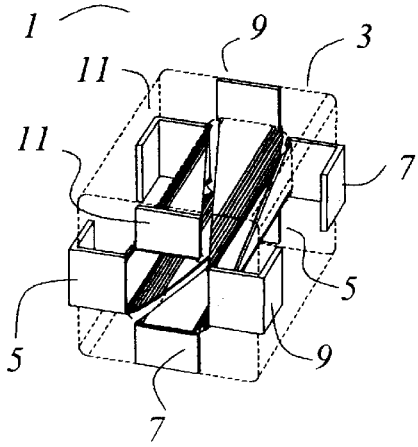
FIG. 4 shows a phantom view of the magnetic core with all four windings installed.

FIG. 4 shows all of the metal foil windings 5, 7, 9 and 11 installed in a magnetic core 3 (shown in phantom). While the shape of the ends of the metal foil windings 5, 7, 9 and 11 are arbitrary, and may vary from application to application, in the present instance it can be seen that the ends that extend vertically are trimmed so they would not touch a top or bottom metal mounting plate if either or both is used. By contrast, the ends that extend horizontally are extended and wrap around to the sides of the cores, to facilitate connections to be made later.

FIG. 5 shows the module 21 of FIG. 2 with the magnetic cores 3, shown in phantom so that the internal configuration and the rear connections of the several metal foil windings and connecting straps can be seen.

Figure 8:
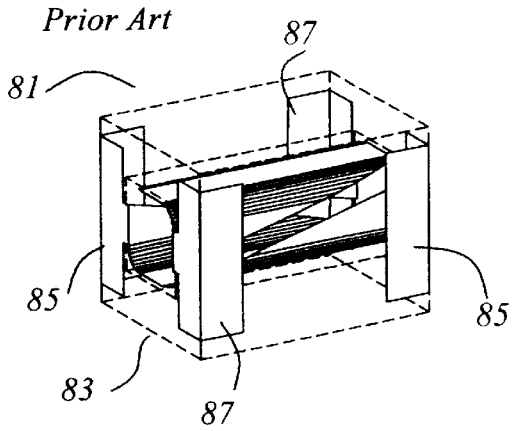
FIG. 8 shows a phantom view of a prior art winding.
Figure 9:
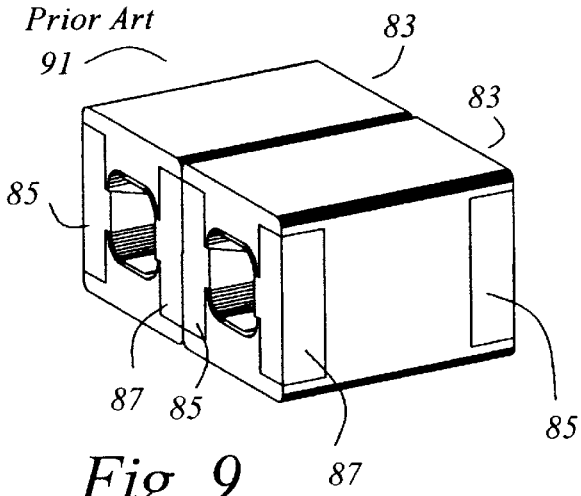
FIG. 9 shows a prior art two turn winding on two cores.

FIGS. 8 and 9 show prior art two winding modules 81 and 91. Two metal foil windings 85 and 87 comprising 180 degree helices are bonded into a magnetic core 83 (shown in phantom in FIG. 8). FIG. 9 shows a two core assembly 91.

"Bonding" may mean assembling together using an adhesive, and usually it is preferred to bond the metal foil windings into the magnetic cores with an adhesive such as epoxy, as an illustration, not a limitation. However, "bonding" may also include any means that retains the metal foil windings in their respective correct positions. Many magnetic materials are conductive, or somewhat conductive. If such a magnetic material is used, it is preferred that there be at least an insulating film on the magnetic core or on the winding to prevent short circuiting, as would be well understood by one skilled in the art of matrix transformers.

\ \ \

\ \ \

\ \ \

\ \ \

What is claimed is:

1. A magnetic core, comprising:

a plurality of sides;

an inside surface;

four metal foil windings;

said metal foil windings bonded to the inside surface; and said metal foil windings comprising a 90 degree helix.

2. A magnetic core, comprising:

a plurality of sides;

an inside surface;

four metal foil windings;

said metal foil windings bonded to the inside surface; and said metal foil windings comprising a 90 degree helix, wherein the metal foil windings have horizontal extensions that extend horizontally, said horizontal extensions having extended ends, and vertical extensions that extend vertically to comprise terminations for the windings.

3. The magnetic core according to claim 2, whereby the horizontal extensions are wrapped around the sides of the magnetic core, and the vertical extensions are trimmed.

4. The magnetic core of claim 2, whereby it is connected to another magnetic core according to the claim 2 by soldering the horizontal extensions of each magnetic core.

5. The magnetic core according to claim 2, whereby it is connected to another magnetic core according to claim 2 by soldering at least one metal strap between the metal foil windings of both magnetic cores.

6. The magnetic core according to claim 5, whereby it is connected to another magnetic core according to claim 2 by soldering at least one metal strap between horizontal extensions of each magnetic core forming a center tap termination.

7. The magnetic core according to claim 5, whereby it is connected to another magnetic core according to claim 2 by soldering at least one metal strap between the horizontal extensions of each magnetic core forming a center tap termination, one end of the horizontal extension serves as an output termination of the core.

8. A magnetic core, comprising:

a plurality of sides;

an inside surface;

four metal foil windings;

said metal foil windings comprising a 90 degree helix;

wherein the metal foil windings have horizontal extensions that extend horizontally;

said horizontal extensions having extended ends;

said horizontal extensions are wrapped around the sides of the magnetic core;

wherein the metal foil windings have vertical extensions that extend vertically to comprise terminations for the windings;

said vertical extensions are trimmed;

said magnetic core is connected to another magnetic core by soldering the horizontal extensions of each magnetic core; and said magnetic core is connected to another magnetic core by soldering at least one metal strap between the metal foil windings of both magnetic cores.

9. The magnetic core according to claim 8, whereby it is connected to another magnetic core according to claim 8 by soldering at least one metal strap between the horizontal extensions of each magnetic core forming a center tap termination.

10. The magnetic core according to claim 8, whereby it is connected to another magnetic core according to claim 8 by soldering at least one metal strap between the horizontal extensions of each magnetic core forming a center tap termination, one end of the horizontal extension serves as an output termination of the core.

* * * * *